US005609281A

United States Patent [19]

West

[11] Patent Number: 5,609,281

[45] Date of Patent: Mar. 11, 1997

[54] COMBINATION BELT AND TOOLS

[76] Inventor: Michael A. West, 1450 W. 228th St., Ste. 14, Torrance, Calif. 90501

[21] Appl. No.: 649,119

[22] Filed: May 14, 1996

[51] Int. Cl.[6] ..... A44B 11/00

[52] U.S. Cl. ..... 224/163; 224/904; 84/163 R

[58] Field of Search ..... 224/163, 904; 24/163 R, 36, 163 K; 7/138, 151, 158, 168, 165, 170; 81/52; 2/300, 312

[56] References Cited

U.S. PATENT DOCUMENTS

| | | | |
|---|---|---|---|
| D. 251,996 | 6/1979 | McKinney, Sr. et al. | D2/427 |
| 4,078,272 | 3/1978 | Mahon, III | 24/186 |
| 4,466,561 | 8/1984 | Slaughter | 224/163 |
| 4,504,993 | 3/1985 | Gamble | 7/165 |
| 4,521,939 | 6/1985 | Chabot et al. | 224/163 |
| 4,529,111 | 7/1985 | Hayakawa | 224/163 |
| 4,747,165 | 5/1988 | Limbach | 2/322 |
| 5,179,748 | 1/1993 | Lipic | 7/165 |
| 5,217,150 | 6/1993 | Chen | 224/163 |

*Primary Examiner*—Henry J. Recla
*Assistant Examiner*—Timothy L. Maust
*Attorney, Agent, or Firm*—James G. O'Neill

[57] ABSTRACT

A belt includes a belt buckle having at least one prong formed to the belt buckle, which prong includes at least one screwdriver tip formed thereon. The belt also includes a belt loop having a wrench formed therein. The belt buckle may have a single prong with a screwdriver bit having different tip ends removably held within a hollow holding portion of the prong, or a screwdriver bit having a selected screwdriver tip at one end thereof may be selectively inserted and held within the prong holding means. Or, the belt buckle may have two different prongs with screwdriver tips, the belt loop may be rectangular with different size wrenches on opposite sides thereof, so as to be reversible on the belt.

15 Claims, 2 Drawing Sheets

COMBINATION BELT AND TOOLS

BACKGROUND OF THE INVENTION

1. Field of the Invention

This invention relates generally to belts, and more particularly, to an improved belt having tools thereon.

2. Description of Related Art

Belts are specifically designed for fastening around the waist of an individual and they usually include some type of belt buckle secured at one end. Many belt buckles are known which may be used as an ornament, and which also may provide additional features or functions. Examples of such belt buckles are shown in U.S. Pat. No. 4,529,111 to Hayakawa, which discloses a buckle for a belt having a flat plate held within the buckle, which flat plate may be removed, and has a number of tools formed in and on the flat plate. Additionally, U.S. Pat. Nos. 4,078,272 to Mahon, III, 4,466,561 to Slaughter, and 5,217,150 to Chen, all show belt buckles having knife blades and tools foldably or slidably mounted within the belt buckles. Finally, U.S. Pat. Nos. 4,747,165 to Limbach and Des. 251,996 to McKinney, Sr. et al., show belt buckles having a removable cork puller, and what would appear to be a built-in can and/or bottle opener therein.

Additionally, U.S. Pat. Nos. 4,504,993 to Gamble and 5,179,748 to Lipic show key rings having tools such as screwdrivers therein.

None of the above identified patents, however, disclose or show a belt having tools forming the prong of the belt buckle and additional tools formed by a belt loop. Therefore, since all of the above-mentioned prior patents require removal of the tool or the like from a belt buckle, there is a need in the art for a belt having tools associated therewith, including tools that do not have to be removed from the belt buckle to be used.

The requirement for tools to be removed from the buckle, as is disclosed in prior art devices may cause problems of availability as well as other problems. These problems are overcome in the present invention by the provision of an easy to manufacture and use belt means, which may be carried or worn anywhere, and which incorporates the needed tools for repair, without have to remove the same

SUMMARY OF THE INVENTION

It is, therefore, a general object of the present invention to provide an improved belt having tools associated therewith. It is a more particular object of the present invention to provide a belt having a buckle containing at least one prong which may be utilized as a screwdriver. It is a still more particular object of the present invention to provide a belt having a belt loop holder which may be utilized as a wrench. It is yet a another object of the present invention to provide a unique belt having a pair of separate prongs on the buckle, and which pass through openings formed in the belt from the buckle, and which prongs are comprised of different types of screwdriver blades. It is a still further particular object of the present invention to provide a unique belt having a single prong in which different screwdriver heads may be held. And, it is yet a still further more particular object of the present invention to provide a belt having at least one screwdriver prong, and a belt loop with interchangeable, separate wrench means thereon.

In accordance with one aspect of the invention, there is provided a novel belt having a buckle secured at one end with at least one prong comprising a screwdriver head integrally formed therewith. The belt also includes a belt loop associated with or mounted adjacent to the belt buckle, which belt loop is made from a hardened material and has a wrench built therein.

The belt of the present invention may also be modified to include a pair of wrenches formed in the belt loop, which wrenches may be easily removed and/or rotated. The belt buckle may be provided with a single or a double prong means, having two separate screwdriver head means.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved combination belt and tool means indicated generally at 10.

Figure 1:
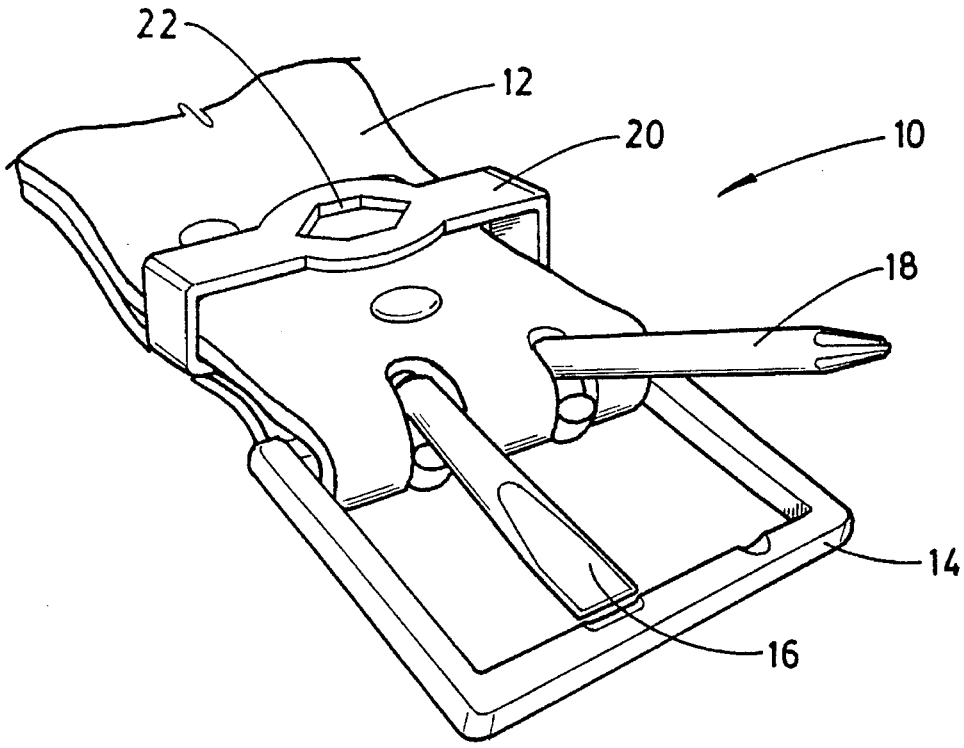
FIG. 1 is a partial perspective view of one embodiment of the belt of the present invention, showing a belt buckle having a pair of screwdriver prongs and a wrench type belt loop on the belt.
Figure 2:
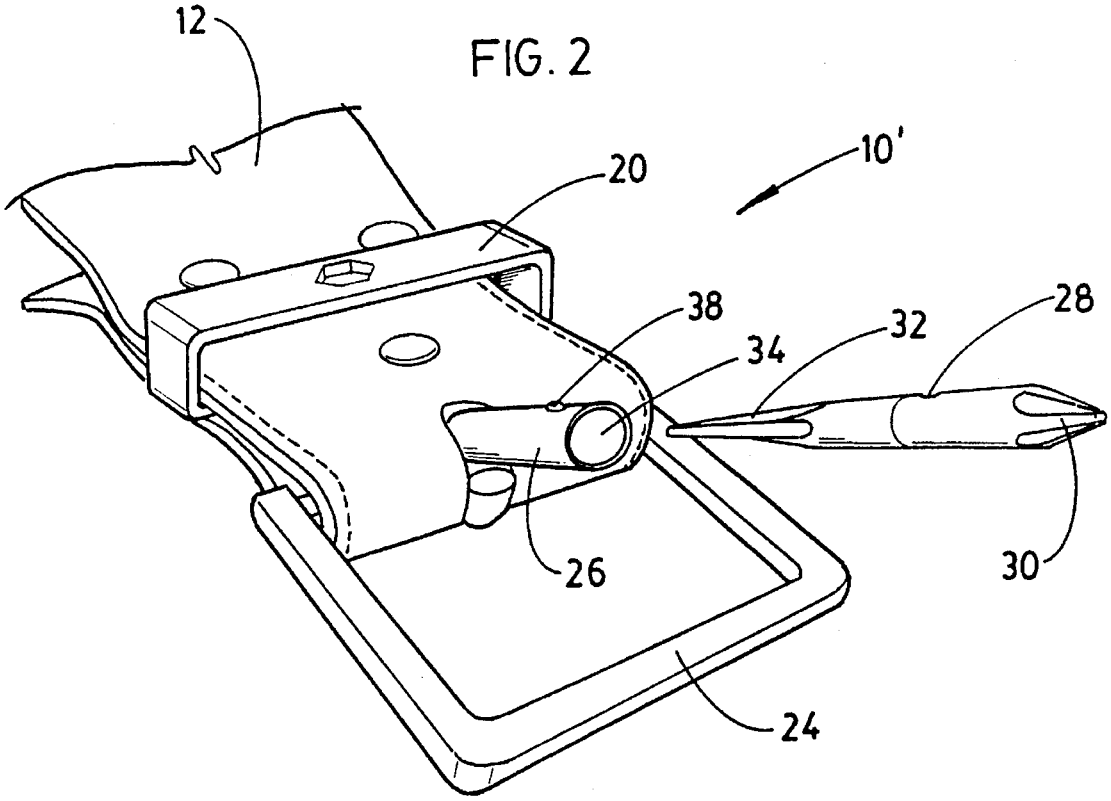
FIG. 2 is a perspective view of a further embodiment of the belt of the present invention showing a belt buckle having a single prong with an interchangeable screwdriver bit insertable therein, and a belt loop having a different size wrench formed thereon.
Figure 3:
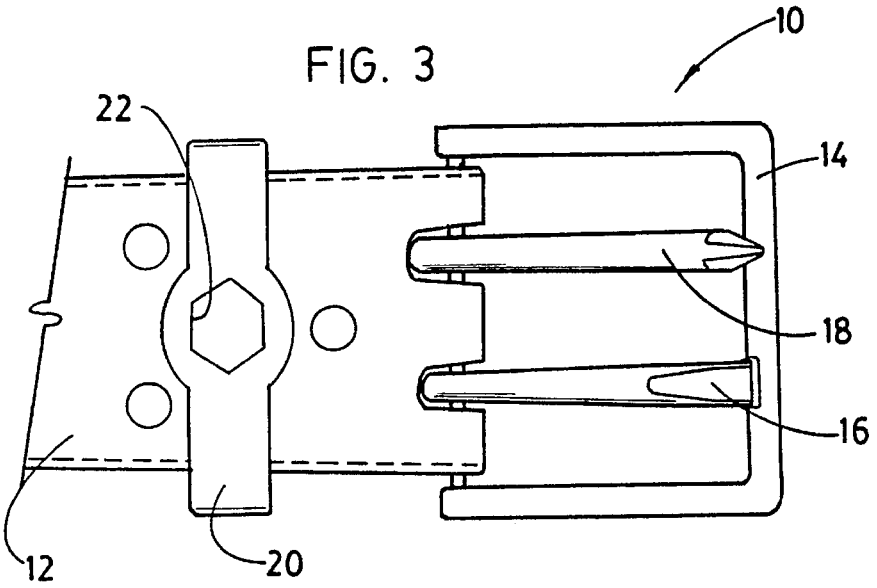
FIG. 3 is a top plan view of the belt buckle of FIG. 1.
Figure 4:
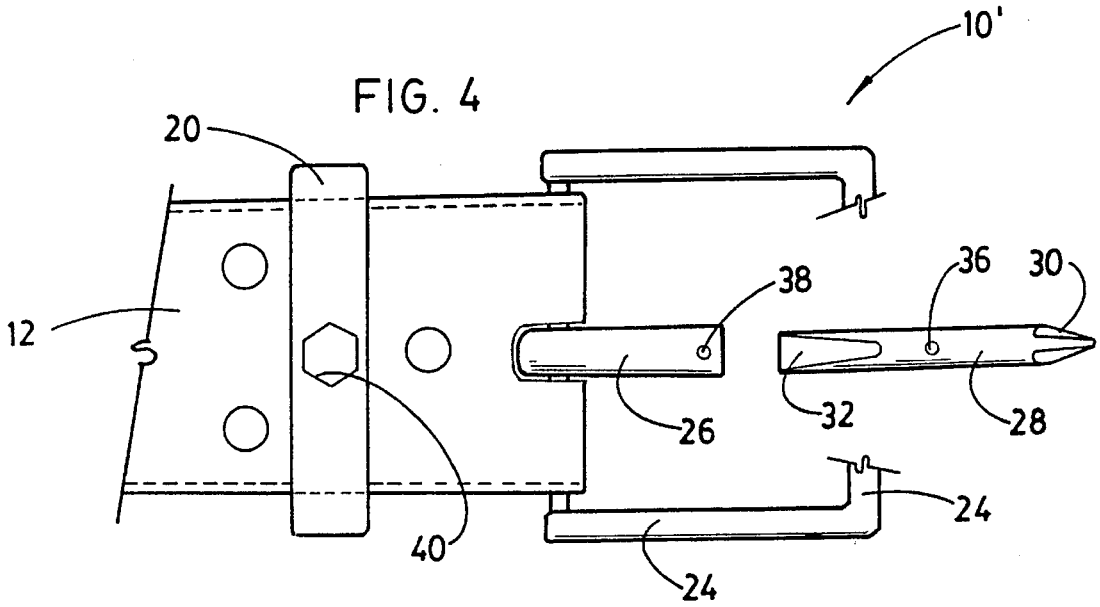
FIG. 4 is a top plan view of the belt buckle of FIG. 2.
Figure 5:
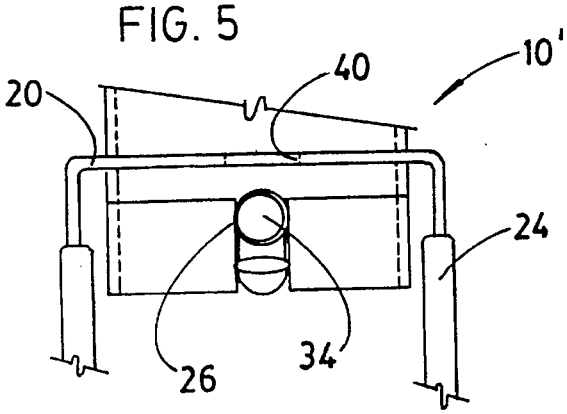
FIG. 5 is a partial front elevational view of the belt buckle of FIG. 2.
Figure 6:
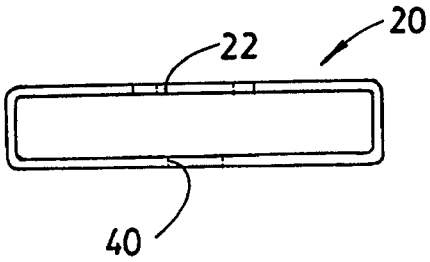
FIG. 6 is a side elevational view of the belt loop removed from either of the belt of FIGS. 1 or 2, with two different size wrenches formed on opposite sides thereof.

As shown in FIG. 1, the combination belt and tool means 10 may include a belt 12, made from leather or other belting means. A buckle 14 is secured to one end of belt 12 so as to have a plurality of prongs 16, 18 rotatably mounted on the buckle 14 extending through the belt. The buckle is preferably formed as a loop from a metal, and the prongs are preferably formed so as to have two ends, one of which is rotatably mounted on the buckle and the other of which are different types of screwdriver tips, such as a flat tip or blade on 16 and a phillips-type screwdriver tip on 18. These outer ends or tips of the prongs cooperate with the buckle. The belt 12 also includes a belt loop means 20, preferably in the form of a rectangle and made from a hardened material, such as a metal or plastic. The belt loop has a wrench means 22, such as the hexagonal wrench shown, formed therein, in an enlarged central portion thereof on one elongated side of the rectangular loop.

It is to be understood that the end of the belt which wraps around the buckle 14 and is secured together, includes openings through which the prongs 16 and 18, rotatably secured to the buckle may extend. Furthermore, fastening means, such as snaps or other known types, are provided thereon so that this end of the belt may be taken apart and either or both the belt loop 20 and buckle 14 may be removed for use, replacement, or reversal, as explained more fully below. That is, the belt buckle 14 may be replaced, by unfastening or unsnapping the belt end holding means of the wrap-around belt portions.

Turning now to FIGS. 2–5, there shown is a further embodiment of the combination belt and tool means 10' of the present invention. In this embodiment, the belt 12 may be the same width or may be a different width, if desired. Moreover, a different buckle 24 is utilized. This buckle 24 has a single, hollow stub or partial prong holding means 26 into which means such as a single prong 28, having a phillips head screwdriver at one end 30 and a flat or straight end 32 at the other end, may be inserted and removed from an opening 34 formed within hollow prong holding means 26. The single prong may include a biased ball 36 secured therein, which cooperates with an opening 38 formed within the opening 34 of the hollow prong holder 26. Or, any other releasable type holding means of a type well known to those skilled in the art, may be utilized for inserting and removing prongs having screwdriver heads thereon.

The belt 10' of FIGS. 2–5 also includes a belt loop 20 which is shown as being reversed to illustrate a further wrench means 40, preferably smaller than the wrench means 22, therein, on the other or reverse elongated side of belt loop 20.

Either of the embodiments of the belt of the present invention may be worn by a user participating in sports such as skateboarding, skiing, snowboarding, or the like. Then, if the board or skis have any components which become loose, the belt may be removed, and a selected tool or tools, such as either screwdriver blade, or either of the wrench means will be available to be used to tighten components thereon. It also may be seen that the tools may be used in any other situation requiring repair of equipment, that only requires a screwdriver and/or wrench to tighten or repair the same.

It, therefore, can be seen that the unique combination belt and tool of the present invention provides a novel means to allow a sports enthusiast, or any other active person wearing the same, to properly repair and/or tighten loose sports equipment or other screw and/or bolts and/or nuts.

Those skilled in the art will appreciate that the above-described preferred embodiments are subject to modifications and adaptations without departing from the scope and spirit of the invention. Therefore, it is to be understood that, within the scope of the appended claims the invention may be practiced other than as specifically described herein.

What is claimed is:

1. A belt having a buckle removably secured thereto and comprising in combination:

said buckle being releasably secured to said belt and having at least one prong therein;

said prong having at least one screwdriver means with a specifically formed screwdriver head at an outer end thereof, away from said belt; said screwdriver head cooperates with a further portion of said buckle; and a belt loop, releasably carried on said belt adjacent to said belt buckle; said belt loop including at least one wrench means formed therein.

2. The belt and buckle combination of claim 1 wherein said prong comprises a hollow portion releasably carrying a screwdriver means therein.

3. The belt and buckle combination of claim 2 wherein the releasable screwdriver means has two ends and includes two different screwdriver tips at opposite ends thereof.

4. The belt and buckle combination of claim 3 wherein said belt loop is substantially rectangular and includes a second wrench means of a different size, formed on a different side thereof.

5. The belt and buckle combination of claim 4 wherein said belt loop is formed from a hardened material.

6. The belt and buckle combination of claim 1 wherein there are two prongs, with each of the prongs having an outer end which is formed as a different screwdriver tip.

7. The belt and buckle combination of claim 6 wherein one of said prong tips is a phillips tip and the other of said prong tips is a flat head tip.

8. The belt and buckle combination of claim 7 wherein said belt loop means is substantially rectangular with a second wrench means formed on a side there of opposite that on which the first wrench means is formed.

9. The belt and buckle combination of claim 8 wherein said belt loop is made from a hardened material selected from the group of metals and plastics.

10. The belt and buckle combination of claim 8 wherein said buckle is substantially rectangular and made from metal.

11. A belt having a buckle end with a buckle having two prongs releasably secured thereto;

said buckle being substantially rectangular with each of said prongs being rotatably mounted on a side thereof which is captured within said belt;

each of said prongs including an outer end, extending away from said belt and, ending in a different type of screwdriver tip; and a metal belt loop removably secured to said buckle end of said belt, adjacent to said buckle.

12. The belt of claim 11 wherein said belt loop is substantially rectangular and includes two different size wrench means formed on opposite sides thereof.

13. A belt having a buckle end with a belt buckle having single prong means therein secured to said belt;

said buckle being substantially rectangular with said single prong means being rotatably mounted on a side of said buckle releasably captured in said buckle end of said belt;

said single prong comprised of a hollow holding member and a screwdriver bit, removably held in said hollow holding member;

a metallic belt loop means removably secured in said buckle end of said belt, adjacent said belt buckle; and said belt loop means including wrench means formed therein.

14. The belt of claim 13 wherein said belt loop is rectangular with two long and two short sides, and two different size wrenches are formed on the two long sides thereof.

15. The belt of claim 14 wherein said belt buckle is metal and said screwdriver bit includes two ends with a phillips tip formed on one end and a straight screwdriver tip on the other of said two ends.

* * * * *